United States Patent [19]

Whitmore

[11] Patent Number: 4,868,066

[45] Date of Patent: Sep. 19, 1989

[54] MECHANICALLY PLATED COATINGS CONTAINING LUBRICANT PARTICLES

[75] Inventor: Bryan Whitmore, New Haven, Conn.

[73] Assignee: MacDermid, Incorporated, Waterbury, Conn.

[21] Appl. No.: 109,955

[22] Filed: Oct. 19, 1987

[51] Int. Cl.[4] ..... B22F 7/00; B05D 3/12

[52] U.S. Cl. ..... 428/551; 428/626; 427/242; 75/231

[58] Field of Search ..... 428/551, 626, 639; 427/221, 242; 75/231

[56] References Cited

U.S. PATENT DOCUMENTS

| | | | |
|---|---|---|---|
| 4,000,982 | 1/1977 | Ueda | 428/639 X |
| 4,429,020 | 1/1984 | Luch | 428/626 X |
| 4,533,606 | 8/1985 | Teng et al. | 428/659 X |
| 4,666,787 | 5/1987 | Bickle et al. | 428/626 X |
| 4,732,818 | 3/1988 | Pratt et al. | 428/551 X |

FOREIGN PATENT DOCUMENTS

| | | |
|---|---|---|
| 0174019 | 2/1985 | European Pat. Off. . |
| 2919726 | 8/1980 | Fed. Rep. of Germany . |

OTHER PUBLICATIONS

"Zinc/Graphite-A Potential Substitute for Anti-Galling Cadmium", by W. A. Donakowski, Plating and Surface Finishing, vol. 70, p. 48 (1983).

"Coatings That are Tough and Slippery", Staff Report.

"Electrtoless Nickel/PTFE Composite-The Niflor Process", by P. R. Ebdon, Int. J. of Vehicle Design, vol. 6, Nos. 4–5, pp. 466–468 (1985).

"Niflor—A New Generation Approach to Self-Lubricating Surfaces", by P. R. Ebdon.

"Electroless Nickel-PTFE Composite Coatings", by S. S. Tulsi.

Mechanical Galvanizing-An Improved Method for Zinc Coating Nails, by H. M. Thrasher (1987).

Mechanical Plating: Utilisation of Mechanical Energy Produces Important Differences Over Conventional Methods, by E. T. Clayton (1976).

*Primary Examiner*—Peter A. Nelson

*Attorney, Agent, or Firm*—St. Onge Steward Johnston & Reens

[57] ABSTRACT

In a mechanical plating process, lubricant particles can be coated on a metal substrate together with the particulate plating metal to enhance the mechanically-applied coating's lubricity. The lubricant can be particles of fluorocarbon polymers, fluorocarbon-hydrocarbon blended polymers, powdered, elemental carbon, powdered fluorinated carbon, or mixtures thereof. The lubricant particles have a diameter less than the thickness of the coating (which is usually from 2.5 to 132.5 mils), so they will not be dislodged from the coating. The particles must not be too small or they may be washed away by plating liquids or may be applied too far from the coating surface to enhance lubricity. These dimensional relationships insure that the lubricant particles are entrapped within the coating.

29 Claims, No Drawings

MECHANICALLY PLATED COATINGS CONTAINING LUBRICANT PARTICLES

BACKGROUND OF THE INVENTION

It has been known to plate metal, metal mixtures, and alloys in particulate form on a metal substrate by applying mechanical force sufficient to cause adhesion between the plating metal particles and the surface of the substrate. The mechanical force necessary to cause such adhesion is achieved by placing the plating metal particles, a solid impaction media (e.g. glass or steel beads), materials which promote such plating, and a metal substrate in a rotating ball mill or a tumbling barrel. In this manner, the rotation of the ball mill or the tumbling of the barrel imparts kinetic energy to the impaction media which is transferred to the plating metal particles such that these particles are pounded into the surface of the substrate as a coating.

Compared to other metal plating techniques, mechanical plating has the significant advantage of avoiding hydrogen embrittlement. Mechanical plating forms a porous coating on a substrate which permits hydrogen within the coating to escape, preventing the formation of stress fractures. By contrast, hydrogen is trapped within the non-porous coatings applied by other techniques (e.g. electroplating), making it likely that such stress fractures will form.

The early work in this field of mechanical plating was disclosed in the U.S. Pat. Nos. 2,640,001, 2,640,002, Re. 23,861, 2,689,808, and 2,723,204 all to Clayton et al. Typically, these mechanical plating processes were undertaken in the presence of a plating liquid containing additives to improve the efficiency of plating and/or the quality of the metal deposited. These additives include surfactants, film-forming materials, antifoaming agents, dispersing agents, and corrosion inhibitors. Some of these materials are often added together to the plating liquid as a promoter chemical. For example, U.S. Pat. No. 3,460,977 to Golben discloses promoter chemicals containing specific surfactants and organic acid materials for mechanical plating. U.S. Pat. No. 3,328,197 to Simon teaches utilizing promoter chemicals in the form of a solid cake or bar which contains a combination of mechanical plating promotor chemicals. As the mechanical plating cycle progresses, the bar or cake dissolves at a rate which provides optimal amounts of promoter chemicals to the mechanical plating process. U.S. Pat. No. 3,268,356 to Simon discloses incrementally adding the promoter chemical and/or the plating metal particles to the plating barrel in successive additions to optimize the density and uniformity of the plating metal coating over the entire substrate surface and to provide a substrate surface for subsequently-applied plating particles.

In U.S. Pat. No. 3,400,012 to Golben, the advantages of electroplating were sought to be achieved in a mechanical plating process. Such galvanomechanical plating was effected by adding to the plating liquid a "driving" or plating-inducing metal and an ionizable salt of the metal to be plated. The "driving" metal selected is one which is less noble than the plating metal or the metal of the metallic surfaces to be plated. For example, in mechanically plating tin onto steel washers, the plating metal is in the form of tin chloride, and the driving metal is aluminum powder.

U.S. Pat. No. 3,531,315 to Golben ("'315 patent") discloses performing a mechanical plating process in the presence of a strong acid. Prior to the '315 patent, agitation of the plating metal, the impaction media, and the substrate generally was conducted in the presence of weak organic acids such as citric acid. This required that the contents of the plating barrel be rinsed free of any strong acids used to clean or copper the parts before starting the citric acid-based plating process. With the process of the '315 patent, it is possible to conduct the mechanical plating process without need for intermediate rinsing steps, rendering the process extremely economical.

In German Patent DE 28 54 159 to Tolkmit, intermediate coatings such as the copper flash coating which is normally applied prior to mechanical plating is applied in a single-stage process from a slurry containing an intermediate coating metal and a final metal.

One form of mechanical plating produces a lighter weight, relatively thin coating of 0.1 to 1.0 mils thick. Another form of mechanical plating, often referred to as mechanical galvanizing, results in the application of a thicker (i.e. from about 1.0 to 5.3 mils) and heavier (i.e. from about 0.7 to 2.5 ounces per square foot) mechanically applied metallic coating. During the development of such mechanical galvanizing processes, it was found that enhanced adhesion of mechanical galvanizing coatings could be achieved by building up thin layers of mechanically plated metal.

U.S. Pat. No. 4,389,431 to Erisman ("'431 patent") adapted the process of the '315 patent to the incremental metal powder additions of mechanical galvanizing. This was achieved with two mechanical promoter systems. The first is a flash promoter which coats the substrate with a thin adherent flash coating of a metal more noble than the plating metal prior to adding the plating metal to the system. The second continuing promoter is then incrementally added with some or all of the incremental additions of a finely divided mechanical plating metal, the layers of which are built up to effect mechanical galvanizing.

It is a common practice to lubricate metal parts with lubricating oils or waxes. Lubricants have been applied to threaded and other fasteners to insure that there is adequate clamping force for structural joints. Lubricity can also be improved by codeposition of polytetrafluoroethylene with nickel in an electroless nickel plating process (i.e. chemically plating nickel ions in a bath containing reducing agent by reducing the ions to metallic nickel) as taught by "Electroless Nickel/PTFE Composites —The Niflor Process" by P. R. Ebdon, Int. J. of Vehicle Design, vol. 6, nos. 4–5 (1985), "'Niflor'—A New Generation Approach to Self Lubricating Surfaces" by P. R. Ebdon, and "Electroless Nickel—PTFE Composite Coatings" by S. S. Tulsi. The resulting coating includes components of the reducing agent (e.g. phosphorus) and is very different than that which can be produced by mechanical plating, because nickel is not soft enough to be mechanically plated and is a barrier material rather than a sacrificial metal like those used in mechanical plating processes such as zinc which corrodes preferentially to the substrate. Alternatively, a lubricating agent has been applied to metals during electroplating by coating a steel substrate with a matrix of zinc or zinc alloys and a fine dispersion of particles consisting of at least one member selected from the group consisting of oxides, carbides, nitrides, borides, phosphides, and sulfides of aluminum, iron, titanium, molybdenum, and copper, as taught by European Pat.

No. 174,019, or by codepositing zinc and graphite on metal by electroplating, as taught by "Zinc/Graphite—A Potential Substitute for Antigalling Cadmium" by W. A. Donakowski, Plating and Surface Finishing, vol. 70, p. 48 (1983). Lubricants have also been applied to metal either by anodization and then thermally depositing fluorocarbons or by topcoating a cermet substrate with a fluorocarbon or by creating cracks in a plated coating and then pressing polytetrafluorothylene particles into the cracks, all taught by "Coatings That Are Tough And Slippery", Materials Engineering, Vol. 102 No. 4, pp. 18–20, April 1985. When these methods are used to provide lubrication for fasteners which also require some corrosion resistance, the parts are first plated with a protective, sacrificial coating such as zinc or cadmium prior to application of the lubricant. These last methods require post-treatment steps to apply the lubricant over the protective metal coating.

SUMMARY OF THE INVENTION

The present invention relates to a process of mechanical plating which will yield a coating of improved lubricity. The objective is achieved by adding lubricant particles to the plating barrel together with the metal powder which is to be mechanically applied. As a result of the smearing and flattening of metal particles on a metal substrate during mechanical plating, the mechanically plated coating, which is quite porous will entrap the lubricant particles. As a result, the inert lubricant particles are incorporated into the plated metal matrix.

DETAILED DESCRIPTION OF THE INVENTION

The process of the present invention is generally similar to prior art mechanical plating processes with respect to operating mode and parameters, the impaction media, the surfactants, the dispersant additives, and the corrosion inhibiting agents. Likewise, the apparatus in which the plating process is carried out can be any of the known mechanical plating barrels or mills.

As taught by the U.S. Pat. Nos. 3,531,315 and 4,389,431 which are incorporated here by reference, a substrate to be plated is placed in a rotatable plating barrel containing a glass bead impaction media. Water and a surface conditioner containing a strong acid such as sulfuric acid are also added to the barrel and then dispersed by rotation of the plating barrel. As shown in the examples of the '431 patent, for instance, such mechanical plating can optionally include precleaning and rinsing prior to the addition of water and strong acid conditioner. Such precleaning can be effected in the plating barrel or in some other tank by either degreasing with an alkaline cleaner, descaling with an acid cleaner, or both degreasing and descaling. After precleaning, the substrate is rinsed. In accordance with the '315 patent and the '431 patent, there is no subsequent draining or rinsing after addition of surface conditioner. Although some oxide scale forms on the substrate between rinsing and the addition of water and strong acid surface conditioner, the sulfuric acid surface conditioner will remove such scale during its dispersion in the rotating barrel.

After dispersion of the sulfuric acid surface conditioner and water in the rotating plating barrel containing the substrate and impaction media and without either draining the acid from the plating barrel or rinsing the substrate with water, a coppering agent (e.g. a composition containing copper sulfate pentahydrate) is added to the plating barrel. This causes copper to be deposited on the surfaces of the substrate which then acts as a base for adhesion of subsequent coatings to the substrate.

A promoter chemical is then added to the plating barrel to provide a proper environment for mechanical plating. In addition, the promoter chemical may also help clean the subsequently-added plating metal powder and control the size of plating metal agglomerates. Suitable promoter chemicals contain a strong acid or acid engendering salt and a salt of a metal which is more noble than the subsequently-added plating metal. Optionally, the promoter can also include a dispersant for the subsequently-added plating metal and/or a corrosion inhibitor. The soluble salts of a metal more noble than the plating metal include cadmium, lead, and preferably tin (e.g. stannous chloride, stannous sulfate). The strong acid or acid engendering salt can be, for example, sulfuric acid, potassium or ammonium bisulfate, sulfamic acid, or sodium bisulfate. The dispersant and the corrosion inhibitor can be any of those disclosed in columns 3–4 of the '315 patent. The promoter contains per 100 square feet of plating surface up to 400 grams of the strong acid or acid engendering salt and from about 10 to about 80 grams of the soluble salt of a metal which is more noble than the plating metal. In addition, effective amounts of dispersant and/or corrosion inhibitor can be added as needed for their intended purposes.

After the promoter is charged to the rotating barrel, plating metal powder is added. The addition of the plating metal powder displaces part or all of the metal of the promoter from the liquid in the plating barrel onto the plating metal and substrate as a flash coating. The rotation of the barrel, which can be continuous or intermittent, then causes the glass bead impaction media to strike the substrate such that the plating metal powder is pounded into adherence with the substrate. The plating metal is preferably zinc, cadmium, aluminum, tin, or mixtures thereof.

Alternatively, the promoter system disclosed by the '431 patent may be used. As noted supra, this system utilizes two promoters—i.e. a flash promoter and a continuing promoter. The flash promoter contains the same ingredients in the same amounts as are used with the promoters described above. The continuing promoter includes per pound of plating metal about 20 to about 150 grams of a strong acid or an acid engendering salt, from about 1 to about 20 grams of a soluble salt of a metal more noble than the plating metal, and optionally, an effective amount of a dispersant capable of dispersing the plating metal and/or an effective amount of an inhibitor capable of inhibiting corrosion of the substrate and the plating metal. The flash promoter is added to the rotating barrel after coppering is completed and before the addition of plating metal powder. The continuing promoter is added with each incremental addition of plating metal powder added to the rotating barrel. The dual promoter system disclosed in the '431 patent is particularly useful when there is an insufficient amount of inhibitor or dispersant in the barrel prior to completion of mechanical plating. When such deficiences occur, as can be determined by one of ordinary skill in the art, the continuing promoter can be added. Such additions of continuing promoter may or may not be needed for each addition of particulate plating metal depending on the degree of corrosion and dispersibility in the plating barrel.

Inert lubricant particles are added to the plating barrel with the plating metal. As noted, rotation of the plating barrel causes the impaction media to strike the substrate and apply plating metal particles to the substrate's surface. As plating metal particles are coated on the substrate, the lubricant particles are entrapped within the coating. When coated in this manner, the resulting coating has enhanced lubricity. By adding the plating metal and lubricant simultaneously to the plating barrel, the resulting coating is a uniform dispersion of particles of the plating metal and the lubricant. In some cases, it may, however, be desired to coat the substrate with a layer of plating metal surrounded by a layer of this uniform dispersion. This latter embodiment is achieved by first making one or more additions of particulate plating metal to the plating liquid and then simultaneously adding the particulate plating metal and the lubricant particles to the plating liquid.

Any inert, solid, particulate lubricant can be used to produce the low-friction coatings. Examples of such lubricants include fluorocarbon polymers such as TEFLON (a trademark of E.I. Du Pont de Nemours & Co., Wilmington, Del.), or FLUO ( a trademark of Micro Powders, Inc., Scarsdale, N.Y.), fluorocarbon-hydrocarbon blended polymers such as the POLYSILKS, POLYFLUOS, and AQUAPOLYFLUO (all trade names of Micro Powders, Inc., Scarsdale, N.Y.), powdered elemental carbon such as DARCO (a trademark of ICI United States, Inc., Wilmington, Del). or MICRO (a trademark of Asbury Graphite Mills, Inc., Asbury, N.J.), and powdered fluorinated carbon such as ACCUFLUOR (a trademark of Allied Chemical Corp., Morristown, N.J.). Of these lubricants, the fluorocarbon-hydrocarbon blended polymers are preferred.

The lubricant particles should be inert and sized to a diameter smaller than the resulting coating thickness so that the particles are entrapped within the mechanically plated coating. When the lubricant particle diameter is much smaller than the coating thickness (i.e. less than 0.5 microns), these particles are likely to be washed away from the metal surface by mechanical plating liquids or may be applied too far from the coating surface to enhance lubricity. When the lubricant particles are too large, they will not be entrapped within the mechanically-applied coating and, therefore, may be dislodged. Thus, lubricant particle sizes which are too large or too small to be effectively trapped in the mechanically applied coating, will not effectively change the coating's lubricity. The thickness of the mechanically-applied coating ranges from 2.5 to 132.5 microns, so the lubricant particles should have an average diameter within this range.

The optimum level of lubricant depends upon the particular application, but the quantity of lubricant usually ranges from 1 to 20% by weight of the entire coating applied to the substrate. A lubricant level range of 5 to 10% by weight of the coating is particularly preferred. The use of too much lubricant tends to decrease adversely the efficiency of the plating process, while too little lubricant is ineffective in reducing friction at the coating surface. Increasing the percentage of the lubricant relative to the plating metal in the mechanically plated coating causes an increase in the lubricity of the coating as can be determined by an increase in the tension/torque ratio. This ratio is calculated from a graph of applied torque versus resulting tension for a threaded bolt-nut assembly using a Skidmore-Wilhelm Torque Tension Tester. (See Table 1.)

When lubricant particles are applied to metal substrates in accordance with the present invention, the coating's lubricity will be increased by at least 10% compared to similar mechanically plated metal coatings to which no lubricant has been applied. This improvement is manifested by at least a 10% reduction in friction when there is relative sliding between these mechanically plated substrates and another surface.

For many years, cadmium coatings have been used in applications where both sacrificial corrosion protection and lubricity are required. However, recent concerns with regard to the toxicological properties of cadmium have led to a search for alternative plating metals. By incorporating lubricant particles in the mechanically plated coating, in accordance with the present invention, it is possible to apply other metals such as zinc and aluminum composites to the substrate without losing the beneficial properties of cadmium coatings. Alternatively, the present invention permits the amount of cadmium in mechanically-applied coatings to be reduced and replaced with another less toxic plating metal.

The following examples illustrate the preparation of lubricant-inclusion coatings on threaded fasteners and their resulting torque-tension properties. These coatings are not limited to threaded fasteners but can be used wherever a coating that is more lubricated than a standard mechanically plated coating is needed. The application of post-treatments for these coatings such as chromate films does not appreciably affect the lubricity of the fasteners.

EXAMPLE 1

Seven hundred grams of 2" steel nut-bolt assemblies were loaded into a 0.1 cubic foot capacity octagonal plating barrel containing a glass impaction media, cleaned with a sulfuric acid surface conditioner, coppered with a copper sulfate solution, and tinned in accordance with the method set forth in the '315 patent. 5.1 grams of zinc powder was then added, and the barrel was allowed to roate for 15 minutes until a layer of zinc 7.2 microns thick was formed on the nut-bolt assemblies. The fasteners were then removed from the barrel, rinsed with water, and dried. The torque-tension relationship for these plated bolt-nut assemblies was then determined using a Skidmore Wilhelm Model J Tester. Plotting the resulting tension for a given applied torque results in a nearly linear plot which reflects the lubricity of the given coating. The slope of this plot (i.e. the resulting tension/torque ratio) for each example is 9.8 lbs./in.—lb, as set forth in Table 1.

EXAMPLE 2

Example 1 is repeated, adding 0.10 grams of the fluorocarbon-hydrocarbon polymer called POLYSILK 14 (in the form of a powder with an average particle size of 3.5 microns) to the plating barrel together with the zinc powder. The tension/torque ratio for this coating was determined as in Example 1. As shown in Table 1, the ratio for Example 2 is 13.2 lbs/in.—lb which is significantly higher than that achieved by Example 1, indicating that the coating of Example 2 has improved lubricity.

EXAMPLE 3

Example 2 is repeated, using 0.25 grams of POLYSILK 14 powder (in the form of a powder with an average particle size of 3.5 microns). As shown in Table 1, the tension/torque ratio for Example 2 is 20 lbs/in.—lb, which is much higher than that of Example 1. An improvement is also achieved relative to Example 2 most likely due to the increased quantity of POLYSILK 14 utilized.

EXAMPLE 4

Example 3 is repeated, using 0.5 grams of the POLYSILK 4 powder (in the form of a powder with an average particle size of 3.5 microns). As shown in Table 1, the tension/torque ratio for Example 4 is 25.0 lbs/in.—lb which is much higher than for Examples 1, 2, and 3.

EXAMPLE 5

Example 2 is repeated, using 0.25 grams of fluorinated, powdered carbon known as ACCUFLUOR (in the form of a powder with an average particle size of 3.3 microns) in place of the POLYSILK powder. As shown in Table 1, the tension/torque ratio for Example 5 is 12.0 lbs/in—lb which is an improvement over that of Example 1.

EXAMPLE 6

Example 5 is repeated, using 0.25 grams of a polytetrafluoroethylene polymer powder known as TEFLON 35 (in the form of a powder with an average particle size range of 0.05 to 0.5 microns in an aqueous dispersion) in place of the carbon powder. As shown in Table 1, the tension/torque ratio has a value of 10.2 lbs/in.—lb which is virtually the same as that achieved in Example 1. The absence of an improvement in Example 6 is believed to be due to the small particle size of TEFLON 35.

EXAMPLE 7

Example 5 is repeated, using 0.50 grams of a different polyfluorotetraethylene polymer powder known as FLUO 300 (in the form of a powder with an average particle size of 2.0 microns) in place of a carbon powder. The tension/torque ratio of 14.6 lbs/in.—lb is better than that achieved by Example 1.

EXAMPLE 8

Example 1 is repeated, using cadmium powder (6.4 grams) in place of zinc. The tension/torque ratio is 12.0 lbs/in.—lb, as given in Table 1.

EXAMPLE 9

Example 8 is repeated, adding 0.10 grams of POLYSILK 14 (in the form of a powder with an average particle size of 3.5 microns) to the plating barrel together with the cadmium powder. As shown in Table 1, the tension/torque ratio which is 20.0 lbs/in.—lb is much better than that achieved in Example 8.

EXAMPLE 10

Example 1 is repeated, using a mixture of aluminum powder, zinc powder, and a promoter. The tension/torque ratio is 12.4 lbs/in.—lb, as given in Table 1.

EXAMPLE 11

Example 10 is repeated, adding 0.20 grams of POLYSILK 14 (in the form of a powder with an average particle size of 3.5 microns) to the plating barrel together with the plating metal powders. The tension/torque ratio is 30.4 lbs/in.—lb, as set forth in Table 1, which is a significant improvement over that achieved in Example 10.

EXAMPLE 12

Example 2 is repeated, using 0.25 grams of carbon powder known as DARCO G-60 (having an average particle size range of 44 to 149 microns) in place of the POLYSILK powder. The tension/torque ratio is 9.7 lbs/in.—lb, as given in Table 1. This constitutes no improvement over Example 1, probably because the particles of carbon used in Example 12 are too big.

EXAMPLE 13

Example 2 is repeated, using 0.5 grams of a graphite powder known as MICRO 650 in the form of a powder with an average particle size of 2.5 microns in place of the POLYSILK powder. The tension/torque ratio is 12.6 lbs/in.—lb., as given in Table 1, which constitutes a significant improvement over Example 1.

EXAMPLE 14

Example 2 is repeated, using 0.20 grams of a lubricant known as POLYFLUO 190 (in the form of a powder with a particle size of 3.0 microns) in place of the POLYSILK powder. As shown in Table 1, the tension/torque ratio is 12.9 lbs/in—lb, which constitutes a significant improvement over Example 1.

EXAMPLE 15

Example 2 is repeated, using 0.45 grams of a lubricant known as AQUA POLYFLUO 411 (in the form of a powder with an average particle size of 3.0 microns) in place of the POLYSILK powder. The tension/torque ratio is 18.7 lbs/in.—lb, as given in Table 1 which is a sizeable improvement over that achieved in Example 1.

TABLE 1

TENSION/TORQUE RATIOS FOR MECHANICALLY APPLIED COATINGS

| Example No. | Coatings | Tension/Torque (lbs/in.-lb.) |
|---|---|---|
| 1 | Zinc | 9.8 |
| 2 | Zinc + 2% POLYSILK 14 | 13.2 |
| 3 | Zinc + 5% POLYSILK 14 | 20.0 |
| 4 | Zinc + 10% POLYSILK 14 | 25.0 |
| 5 | Zinc + 5% ACCUFLUOR | 12.0 |
| 6 | Zinc + 5% TEFLON 35 | 10.2 |
| 7 | Zinc + 10% FLUO 300 | 14.6 |
| 8 | Cadmium | 12.0 |
| 9 | Cd + 2% POLYSILK 14 | 20.0 |
| 10 | Al:Zn | 12.4 |
| 11 | Al:Zn + 4% POLYSILK 14 | 30.4 |
| 12 | Zinc + 5% DARCO G-60 | 9.7 |
| 13 | Zinc + 10% Micro 650 | 12.6 |
| 14 | Zinc + 4% POLYFLUO 190 | 12.9 |
| 15 | Zinc + 9% AQUA POLYFLUO 411 | 18.7 |

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A mechanically plated article with improved lubricity comprising:

a metal substrate and a mechanically applied coating on said metal substrate which comprises a plating metal and particles of a lubricant entrapped within said coating by the plating metal.

2. A mechanically plated article according to claim 1, wherein the plating metal is selected from the group consisting of zinc, cadmium, aluminum, tin, and mixtures thereof.

3. A mechanically plated article according to claim 2, wherein the plating metal is zinc.

4. A mechanically plated article according to claim 2, wherein the plating metal is a mixture of zinc and cadmium, the quantity of the cadmium used in said coating being insufficient to lubricate said substrate effectively.

5. A mechanically plated article according to claim 2, wherein the lubricant is selected from particles of either fluorocarbon polymers, fluorocarbon-hydrocarbon blended polymers, elemental carbon, and fluorinated carbon, and mixtures thereof.

6. A mechanically plated article according to claim 1, wherein the lubricant is selected from particles of either fluorocarbon polymers fluorocarbon-hydrocarbon blended polymers, elemental carbon, and fluorinated carbon, and mixtures thereof.

7. A mechanically plated article according to claim 6, wherein the lubricant is a fluorocarbon-hydrocarbon blended polymer powder.

8. A mechanically plated article according to claim 1, wherein the lubricant particles have a diameter less than the thickness of said coating.

9. A mechanically plated article according to claim 8, wherein said coating is 2.5 to 132.5 microns thick.

10. A mechanically plated article according to claim 1, wherein the lubricant is 1 to 20% by weight of said coating.

11. A mechanically plated article according to claim 10, wherein the lubricant is 5 to 10% by weight of said coating.

12. A mechanically plated article according to claim 1, wherein said coating comprises a dispersion of particles of the plating metal and the lubricant.

13. A mechancially plated article according to claim 1, wherein said coating comprises a layer of plating metal adjacent said substrate and a layer of a dispersion of particles of the plating metal and the lubricant surrounding the layer of plating metal.

14. A process of mechanically plating a metal substrate to form a coating with improved lubricity comprising the steps of:

providing a plating liquid containing said metal substrate and an impaction media;

adding to said plating liquid a particulate plating metal and particles of a lubricant; and agitating the plating liquid, whereby said impaction media strikes said metal substrate and causes the particulate plating metal and the lubricant particles to adhere to said metal substrate as a coating.

15. A process of mechanically plating according to claim 14, wherein the plating metal is selected from the group consisting of zinc, cadmium, aluminum, tin, and mixtures thereof.

16. A process of mechanically plating according to claim 15, wherein the plating metal is zinc.

17. A process of mechanically plating according to claim 15, wherein the plating metal is a mixture of zinc and cadmium, the quantity of the cadmium used in said coating being alone insufficient to lubricate said substrate effectively.

18. A process of mechanically plating according to claim 15, wherein the lubricant is selected from particles of either fluorocarbon polymers, fluorocarbon-hydrocarbon blended polymers, elemental carbon, fluorinated carbon, and mixtures thereof.

19. A process of mechanically plating according to claim 14, wherein the lubricant is selected from particles of either fluorocarbon polymers, fluorocarbon-hydrocarbon blended polymers, elemental carbon, fluorinated carbon, and mixtures thereof.

20. A process of mechanically plating according to claim 19, wherein the lubricant is a fluorocarbon-hydrocarbon blended polymer powder.

21. A process of mechanically plating according to claim 14, wherein the lubricant particles have a diameter less than the thickness of said coating.

22. A process of mechanically plating according to claim 21, wherein said coating is 2.5 to 132.5 microns thick.

23. A process of mechanically plating according to claim 14, wherein the lubricant is 1 to 20% by weight of said coating.

24. A process of mechanically plating according to claim 23, wherein the lubricant is 5 to 10% by weight of said coating.

25. A process of mechanically plating according to claim 14, wherein said adding comprises:

adding simultaneously the particulate plating metal and the lubricant particles to the plating liquid.

26. A process of mechanically plating according to claim 14, wherein said adding comprises in sequence:

adding the particulate plating metal to the plating liquid and adding simultaneously the particulate plating metal and the lubricant particles to the plating liquid.

27. A process of mechanically plating according to claim 14, wherein said agitating is continuous.

28. A process of mechanically plating according to claim 14, wherein said agitating is intermittent.

29. A process of mechanically plating a metal substrate to form a coating with improved lubricity comprising the steps of:

contacting said metal substrate with an acidic solution to clean and descale the surfaces of said metal substrate;

rinsing said metal substrate with water;

adding a surface conditioner containing strong acid to an agitated plating barrel containing impaction media and said metal substrate to maintain the surfaces of said metal substrate clean and oxide-free;

without intermediate rinsing, adding to the agitated plating barrel a coppering agent which forms a thin copper coating on the clean, oxide-free surfaces of said metal substrate;

without intermediate rinsing, adding to said agitated plating barrel a metal salt more noble than the ultimate plating metal and a small quantity of particulate coating metal to flash coat the coppered surfaces of said substrate with said more noble metal; and without intermediate rinsing, adding to said agitated plating barrel a particulate plating metal and particles of a lubricant, whereby said impaction media strikes the metal substrate and causes the particulate plating metal and the lubricant particles to adhere to said metal substrate as a coating.

* * * * *